United States Patent [19]

Lense

[11] Patent Number: 4,860,493

[45] Date of Patent: Aug. 29, 1989

[54] NON-BACKDRIVING ACTUATOR FOR OPENING AND CLOSING A WINDOW SASH

[75] Inventor: Robert F. Lense, Rockford, Ill.

[73] Assignee: Amerock Corporation, Rockford, Ill.

[21] Appl. No.: 269,492

[22] Filed: Nov. 10, 1988

[51] Int. Cl.[4] ..... E05F 11/02; E05F 11/24

[52] U.S. Cl. ..... 49/279; 49/341; 49/394

[58] Field of Search ..... 49/339, 340, 341, 280, 49/279, 139, 394, 82

[56] References Cited

U.S. PATENT DOCUMENTS

| | | | |
|---|---|---|---|
| 391,678 | 10/1888 | Benner | 49/341 |
| 891,326 | 6/1908 | Chegwidden et al. | 49/341 X |
| 3,474,572 | 10/1969 | Rothemund | 49/394 X |
| 3,911,623 | 10/1975 | Walter | 49/394 X |
| 4,553,656 | 11/1985 | Lense | 49/139 X |

*Primary Examiner*—Philip C. Kannan

*Attorney, Agent, or Firm*—Leydig, Voit & Mayer

[57] ABSTRACT

A shaft of a window actuator is operable to open and close a casement window sash when the shaft is rotated either by a hand crank or by a motor from inside of the premises. The shaft is automatically locked against rotation if a backdriving force is applied to the actuator from outside the premises. This prevents an open sash from being buffeted by wind and from being pulled open further by a potential intruder.

10 Claims, 2 Drawing Sheets

NON-BACKDRIVING ACTUATOR FOR OPENING AND CLOSING A WINDOW SASH

BACKGROUND OF THE INVENTION

This invention relates generally to apparatus for use with windows and specifically for use with windows such as a casement window or an awning window having a sash which is adapted to be swung between closed and open positions.

Modern casement and awning windows usually are associated with a reversible rotary actuator which may be used to open and close the window sash. The actuator may include a hand crank adapted to be turned in one direction to open the sash and in the opposite direction to close the sash. Alternatively, the actuator includes a reversible electric motor which is associated with the sash in the manner disclosed in Lense U.S. Pat. No. 4,553,656.

Window actuators of the type which are presently used commercially are capable of being backdriven. That is to say, the actuator moves and permits movement of the sash when an external force such as wind is exerted on the sash. With such actuators, wind is capable of buffeting the sash and can cause noise and vibration as well as possible damage to the sash. In addition, an intruder can force the sash open by pulling on the sash and backdriving the actuator and thus the intruder may take advantage of a partially open sash to gain easy entry to the premises.

SUMMARY OF THE INVENTION

The general aim of the present invention is to provide a new and improved window actuator which, while enabling the sash to be opened and closed in a normal manner from inside the premises, is disabled in a backdrive mode and thus reduces wind buffeting of the sash and reduces the ability of a potential intruder to swing the sash open from outside of the premises.

A related object of the invention is to provide an actuator which enables the sash to be easily moved in either direction from inside the premises while preventing wind from moving the open sash in either direction.

Still another object is to provide an actuator which is capable of preventing backdriving of the sash from the outside while enabling smooth and non-jerky opening and closing of the sash from the inside.

The invention also resides in the relatively simple, inexpensive and compact construction of the actuator.

These and other objects and advantages of the invention will become more apparent from the following detailed description when taken in conjunction with the accompanying drawings.

DETAILED DESCRIPTION OF THE PREFERRED EMBODIMENT

Figure 2:
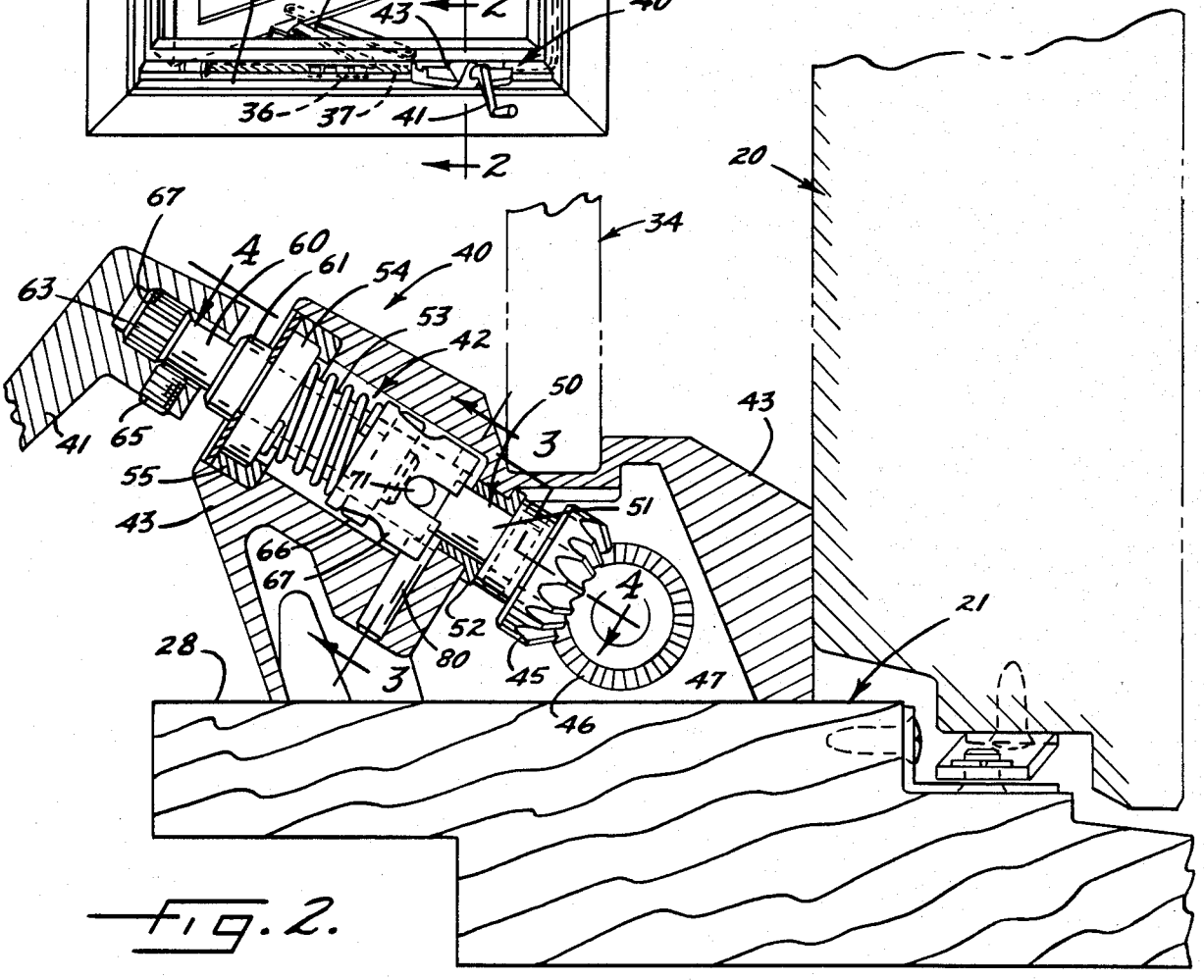
FIG. 2 is an enlarged fragmentary cross-section taken substantially along the line 2—2 of FIG. 1 but shows the sash in a closed position.

For purposes of illustration, the invention is shown in the drawings as being embodied in apparatus for causing a casement window sash 20 to swing between closed and open positions in a window frame 21. The sash itself is of conventional rectangular construction and includes a glass pane 22 which is supported by horizontal top and bottom members 23 and 24 and by left and right upright side members 25 and 26. The frame 21 also is rectangular and is defined by a top header 27, a bottom sill 28 and by left and right side jambs 29 and 30. A screen 34 (FIG. 2) is removably positioned in the opening defined by the frame 21.

The sash 20 is supported for movement between its closed and open positions in a conventional manner. A link 35 is connected pivotally between the bottom member 24 of the sash and a nut 36 which is threaded onto a lead screw 37. Rotation of the lead screw in one direction effects opening of the sash while rotation of the lead screw in the opposite direction effects closing of the sash. Reference may be made to my commonly assigned U.S. application Ser. No. 219,582, filed July 14, 1988 for a detailed disclosure of the linkage formed by the link 35, the nut 36 and the lead screw 37.

Figure 1:
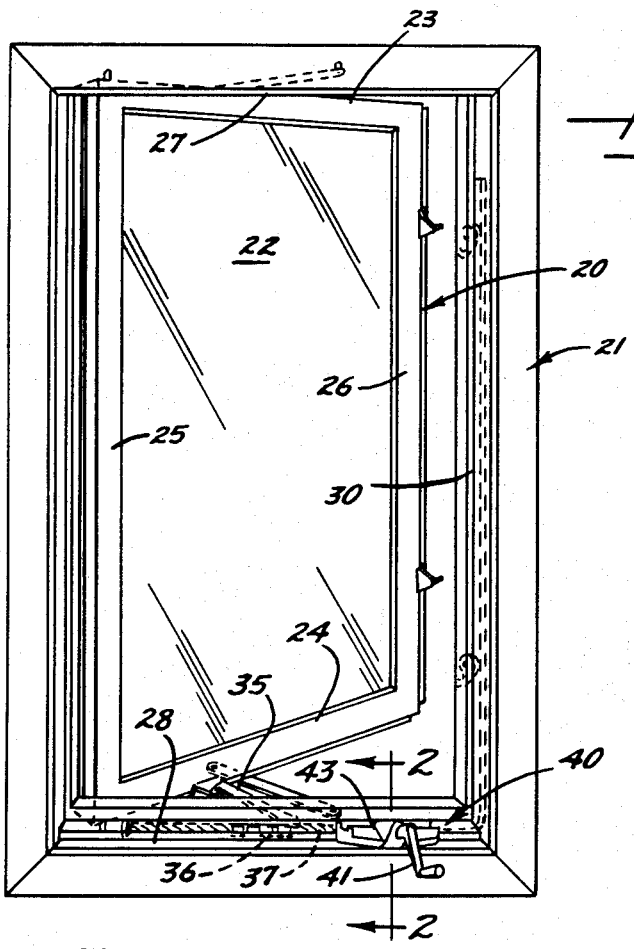
FIG. 1 is a perspective view of a window equipped with a new and improved sash actuator incorporating the unique features of the present invention and shows the sash in a partially open position.

Rotation of the lead screw 37 is effected by a reversible rotary actuator 40 which, in this particular instance, includes a conventional hand crank 41. The crank is connected rigidly to the inner end portion of a shaft assembly 42 (FIG. 2) which is rotatably journaled in an actuator housing 43 fastened to the sill 28. A miter gear 45 (FIG. 2) on the outer end of the shaft assembly meshes with a miter gear 46 on one end of the lead screw 37. The sash 20 is opened and closed when the crank 41 is turned clockwise (FIG. 1) and counterclockwise, respectively.

In accordance with the present invention, the actuator 40 is of a unique construction which enables the sash 20 to be opened or closed in a conventional manner by the crank 41 but which is incapable of being backdriven by the sash. As a result, the actuator holds the sash very rigidly in its open position and prevents the sash from being moved in either direction from outside the premises. This prevents the sash from being buffeted by wind and also prevents a potential intruder from pulling on a partially open sash and moving the sash to a more widely open position.

Figure 4:
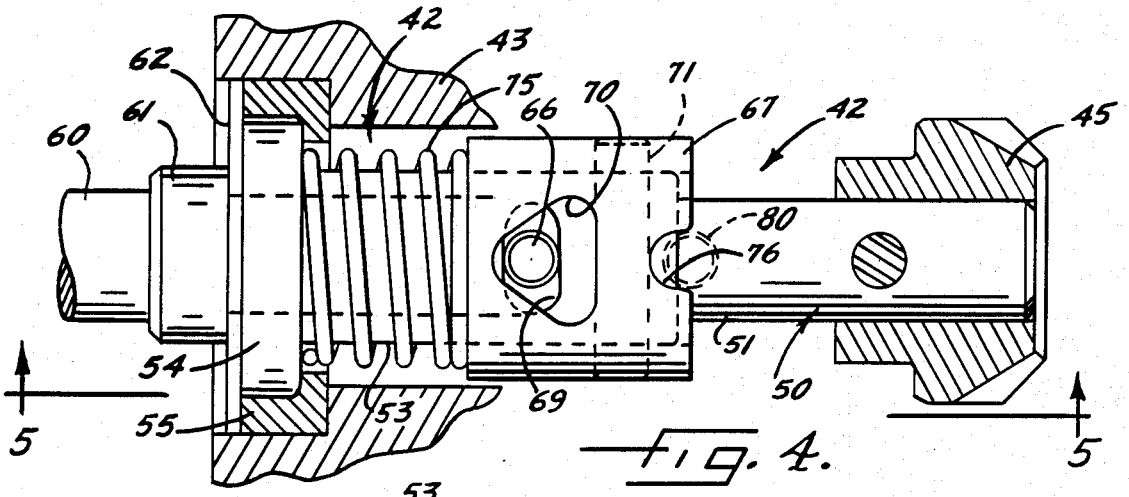
FIG. 4 is an enlarged fragmentary cross-section taken substantially along the line 4—4 of FIG. 2 and shows the parts of the actuator as positioned when the actuator is at rest.

More specifically, the foregoing is achieved by making the shaft assembly 42 of the actuator 40 of a novel two-section construction. The first shaft section 50 (FIG. 4) carries the miter gear 45 and its outer end portion 51 is solid and is rotatably journaled in a bushing 52 (FIG. 2) in the housing 43. The inner end portion 53 of the shaft section 50 is tubular and its extreme inner end is formed with an enlarged radially outwardly projecting flange 54 (FIG. 4) which is rotatably journaled in a bushing 55 in the housing 43.

Figure 6:
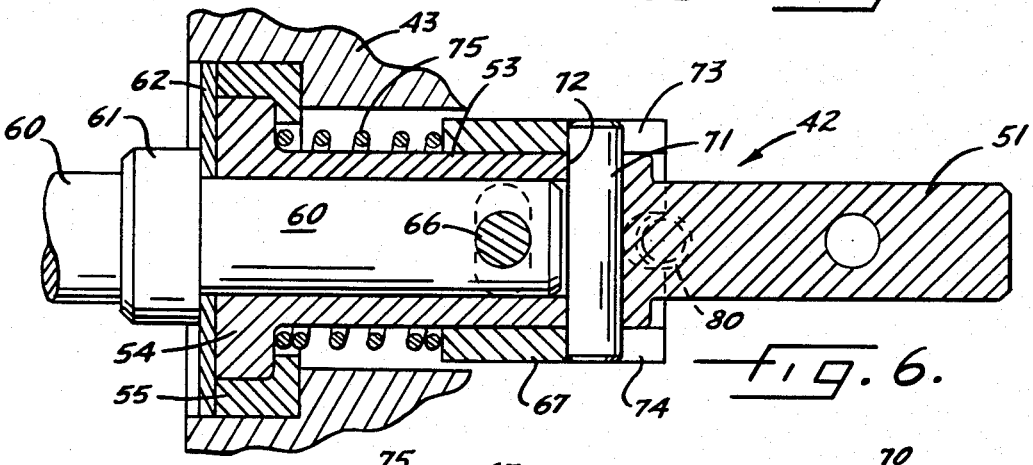
FIG. 6 is a cross-section taken substantially along the line 6—6 of FIG. 5.

The second section 60 (FIG. 6) of the shaft assembly 42 is defined by a spindle which is telescoped into the tubular inner end portion 53 of the first shaft section 50. An enlarged collar 61 is formed on the spindle 60 between the ends thereof and engages a thrust washer 62 which is located in the housing 43 at the inner faces of the flange 54 and the bushing 55. The extreme inner end of the spindle 60 is splined as indicated at 63 in FIG. 2 and fits into a splined bore 64 in the crank 41. A set screw 65 anchors the crank 41 to the spindle 60 so that the spindle is rotated whenever the crank is turned.

Pursuant to the invention, the actuator 40 includes a coupling having a driving member 66 connected to rotate with the spindle 60 and having a driven member 67 connected to rotate with the shaft 50. Herein, the driving member 66 of the coupling is simply a pin which is received with a press fit in a radial bore 67 in the inner end portion of the spindle 60 and whose end portions project radially outwardly from the spindle. The two end portions of the pin 66 are received in circumferentially elongated and diametrically spaced slots 69 (FIG. 4) formed through the tubular inner end portion 53 of the shaft 42.

The driven member 67 of the coupling is in the form of a sleeve which is telescoped slidably over the inner end portion 53 of the shaft 42. Formed through and spaced diametrically around the sleeve 67 are two generally triangular slots 70 which receive the drive pin 66. Each triangular slot is formed with a circumferentially elongated outer base and is oriented such that one apex of the slot points inwardly along the axis of the spindle 60.

To couple the driven member 67 of the coupling for rotation with the shaft 50, a connecting pin 71 (FIG. 6) is received with a press fit in a radially extending bore 72 formed in the tubular inner end portion 53 of the shaft 50 and located near the junction of the shaft portions 52 and 53. The end portions of the pin 71 project radially outwardly from the shaft portion 53 and are slidably but non-rotatably received in a pair of axially elongated and diametrically spaced slots 73 and 74 formed through and opening out of the outer end portion of the sleeve 67. A coil spring 75 is telescoped over the tubular shaft portion 53 and is compressed between the outer face of the flange 54 and the inner end of the sleeve 67 so as to urge the sleeve outwardly relative to the shaft portion 53 and to a position in which the slots 73 and 74 bottom against the pin 71. For a purpose to be explained subsequently, two additional diametrically spaced slots 76 and 77 are formed through and open out of the outer end portion of the sleeve 67 and each is located midway between the slots 73 and 74. Each of the slots 76 and 77 has the same circumferential width as the slots 73 and 74 but is somewhat shorter in axial length.

Figure 3:
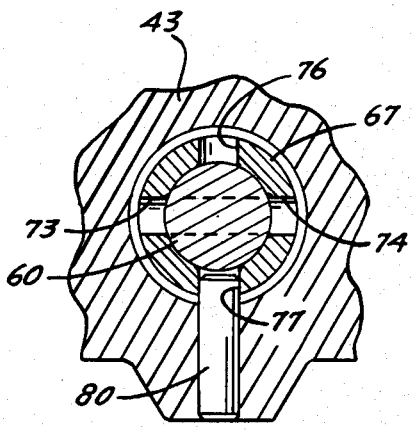
FIG. 3 is an enlarged fragmentary cross-section taken substantially along the line 3—3 of FIG. 2.
Figure 5:
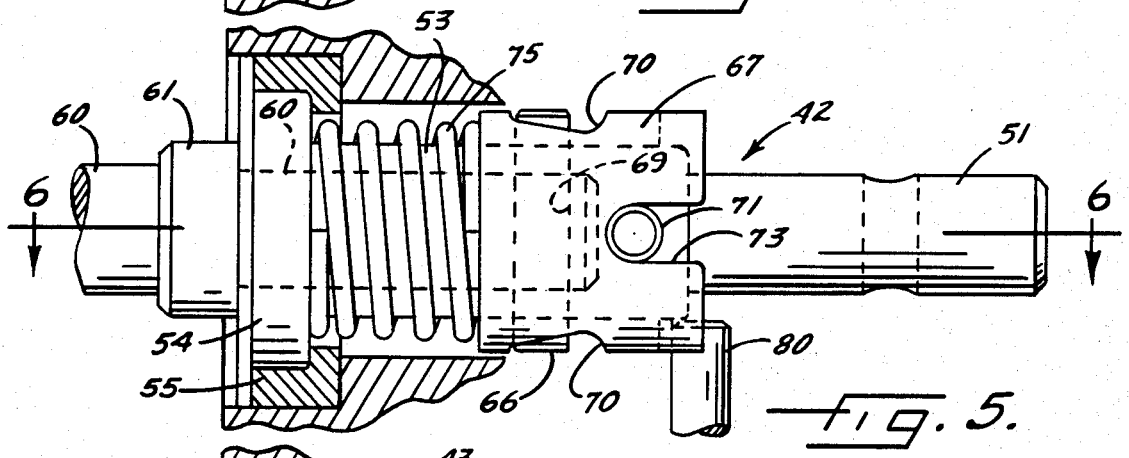
FIG. 5 is a side elevational view of certain parts of the actuator as seen along the line 5—5 of FIG. 4.

The actuator 40 is completed by a locking pin 80 (FIGS. 3 and 5) which is anchored within the housing 43. The pin 80 extends radially inwardly from the housing and is located adjacent the outer end of the sleeve 67.

In order to gain an understanding of the operation of the actuator 40, assume that the sash 20 is at rest and that it is desired to open the sash from inside of the premises. When the sash is at rest, the end portions of the pin 66 may be located adjacent the inner apices of the triangular slots 70 in the sleeve 67 and may be located about midway between the ends of the elongated slots 69 in the tubular shaft portion 53. When the pin 66 is so located, the spring 75 is free to push the sleeve 67 outwardly. This causes the sleeve to be positioned such that the end portion of the locking pin 80 is received in one of the four slots 73, 74, 75 or 76 in the sleeve. As a result, the pin 80 holds the sleeve 67 and the shaft 50 against rotation.

To effect opening of the sash 20, the crank 41 is turned in a clockwise direction and acts on the splines 63 to turn the spindle 60 in the same direction. After the spindle has turned through just a very short distance, the end portions of the pin 66 engage corresponding side edges of the triangular slots 70 in the sleeve 67. As a result, the pin 66 cams the sleeve inwardly to retract the notch 73, 74, 75 or 76 inwardly from the locking pin 80. This frees the sleeve 67 and the shaft section 50 for rotation.

As the spindle 60 turns further, the end portions of the drive pin 66 bottom against circumferentially facing ends of the elongated slots 69 in the shaft portion 53. As a result, the pin 66 rotates the shaft portion 53 and the miter gear 45 thereon and acts through the lead screw 37 to swing the sash 20 open. If the crank is rotated in a counterclockwise direction, the pin 66 engages the opposite side edges of the trianglar slots 70 to cam the sleeve 67 inwardly and also engages the opposite circumferentially spaced ends of the slots 69 and produces counterclockwise turning of the shaft 50 to effect closing of the sash.

Assume now that an intruder pulls on a partially open sash 20 and tries to pull the sash to a more nearly open position by causing the sash to backdrive through the actuator 40 and turn the shaft 50, the spindle 60 and the crank 41 clockwise. Under such circumstances, the shaft 50 is locked against rotation by virtue of the pin 80 seating in one of the notches 73, 74, 75 or 76. Since the shaft 50 cannot rotate, no rotary motion is imparted to either the sleeve 67 or the pin 66 and thus the pin 66 is ineffective to cam the sleeve inwardly and retract the sleeve away from the locking pin 80. Thus, no rotation of the shaft 50 or the spindle 60 can occur when an intruder pulls on the sash or when wind exerts an opening force on the sash. A similar locking action occurs if wind exerts a closing force on the sash or if a person attempts to close the sash from outside of the premises.

From the foregoing, it will be apparent that the present invention brings to the art a new and improved actuator 40 which permits the sash 20 to be opened and closed from inside the premises but which prevents the sash from being buffeted by wind or being opened from outside the premises. When the sash 20 is at rest, it may be that the locking pin 80 will not be alined angularly with one of the notches 73, 74, 75 or 76 but instead will be located between notches and in engagement with the outer end of the sleeve 67. Under such circumstances, the actuator 40 operates substantially as described previously. If a force is applied to the sash from outside the premises, such force merely causes the shaft 50 and the sleeve 67 to rotate until one of the notches 73, 74, 75 or 76 becomes angularly alined with the locking pin 80. At that time, the spring 75 snaps the sleeve 67 forwardly to cause the appropriate notch to receive and lock against the locking pin. Thus, at most, the sleeve 67 can rotate through only ninety degrees when an outside force is exerted on the sash. At that point, the coaction of the locking pin 80 with one of the notches causes the actuator to lock up. If desired, additional anglarly spaced notches may be formed in the sleeve 67 to reduce even further the range through which the sleeve may rotate before being locked by the pin 80.

Figure 7:
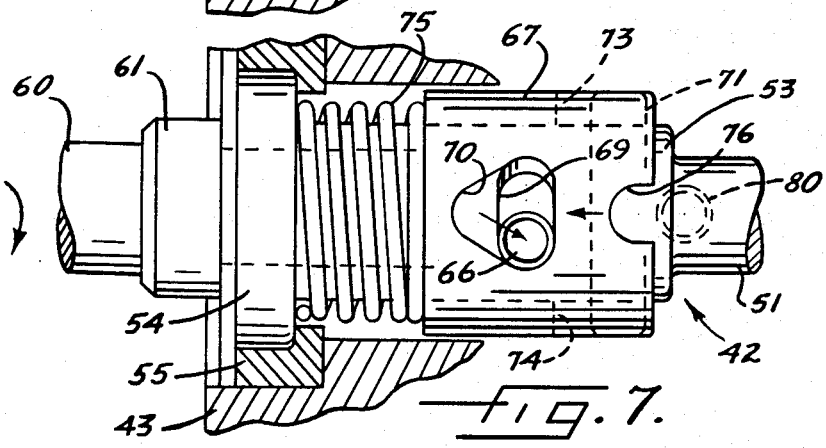
FIG. 7 is a view similar to FIG. 4 but shows the parts of the actuator as positioned when the actuator is being turned from inside the premises.
Figure 8:
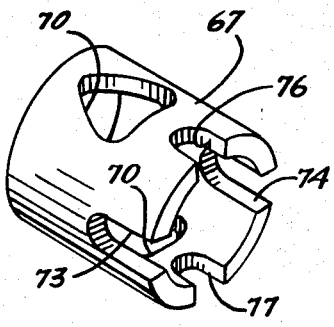
FIG. 8 is a perspective view of one of the components of the actuator.

If torque is exerted on the shaft 50 by way of the spindle 60 when the pin 80 is in engagement with the outer end of the sleeve 67, the sleeve merely turns past the pin and does not shift outwardly to enable one of the notches 73, 74, 75 or 76 to embrace and lock against the pin. This is due to the coaction between the pin 66 and the triangular slots 69 keeping the sleeve 67 retracted inwardly from the locking pin 80 as shown in FIG. 7. The force exerted on the sleeve 67 by the spring 75 is significantly less than the resistance load of the components of the sash 20 located downstream of the miter gear 45. As a result, the spring is not effective to force the sleeve outwardly during opening and closing of the sash from inside the premises and thus the notches 73, 74, 75 and 76 do not ratchet past the locking pin 80 during normal opening and closing of the sash. Accordingly, normal opening and closing is effected with a smooth and non-jerky motion.

What is claimed is:

1. An actuator for moving a window sash between open and closed positions, said actuator comprising a housing, a shaft assembly rotatably supported by said housing, said shaft assembly having first and second end portions and having a section located between said end portions, a linkage connected between said shaft assembly and said sash and operable to move said sash toward said open position when said shaft section is rotated in one direction and to move said sash toward said closed position when said shaft section is rotated in the opposite direction, the improvement in said actuator comprising means for restricting rotation of said shaft section in either direction when torque of predetermined magnitude is applied to said first end portion of said shaft assembly without being transmitted to said first end portion from said second end portion, said means permitting said shaft section to rotate in either direction when torque of the same magnitude is applied to said second end portion of said shaft assembly without being transmitted to said second end portion from said first end portion.

2. An actuator as defined in claim 1 in which said means act to lock said shaft section against rotation relative to said housing when torque is applied in either direction to the first end portion of said shaft means.

3. An actuator as defined in claim 1 in which said shaft assembly comprises first and second shafts having adjacent end portions, said first and second end portions of said shaft assembly being defined by the non-adjacent end portions of said shafts, said shaft section forming part of said first shaft.

4. An actuator as defined in claim 3 in which said means act to lock said first shaft to said housing and to thereby restrict rotation of said first shaft relative to said housing when said linkage applies torque in either direction to said first shaft.

5. An actuator as defined in claim 3 in which said means include a driving member connected to rotate with said second shaft and further include a driven member connected to rotate with said first shaft, means for coupling said driving and driven members for rotation in unison when torque of said predetermined magnitude is applied to said driving member without being transmitted to said driving member from said driven member, and means for locking said driven member to said housing and restricting rotation of said driven member to a limited angular distance when torque of said predetermined magnitude is applied to said driven member without being transmitted to said driven member from said driving member.

6. An actuator as defined in claim 5 in which said locking means comprise a pin anchored to said housing and further comprise angularly spaced notches formed in said driven member and adapted to receive said pin, and means for causing said notches to shift away from said pin when said driving member is rotated.

7. An actuator as defined in claim 6 in which said shifting means comprise a cam on one of said members and a cam follower on the other of said members.

8. An actuator as defined in claim 7 in which said cam is a pin on said driving member, said cam follower comprising a recess formed in said driven member and receiving said pin.

9. An actuator as defined in claim 8 in which said driving member is supported to slide between active and inactive positions on said second shaft, a spring urging said driving member to said active position, said pin acting against the edge of said recess and camming said driving member to said inactive position when said second shaft is rotated relative to said first shaft.

10. A non-backdriving actuator for moving a window sash between open and closed positions, said actuator comprising a housing, first and second shafts rotatably supported by said housing, a linkage connected between said first shaft and said sash and operable to move said sash toward said open position when said first shaft is rotated in one direction and to move said sash toward said closed position when said first shaft is rotated in the opposite direction, means permitting said shafts to rotate relative to one another through a limited angular distance and thereafter coupling said shafts together for rotation in unison, means for restricting rotation of said first shaft in either direction when torque is applied to said first shaft without being transmitted to said first shaft from said second shaft, and cam means responsive to relative rotation of said shafts for disabling said restricting means so as to permit rotation of said first shaft in either direction when torque is applied to said second shaft without being transmitted to said second shaft from said first shaft.

* * * * *